US006758357B2

(12) United States Patent
Grillo

(10) Patent No.: US 6,758,357 B2
(45) Date of Patent: Jul. 6, 2004

(54) GLASS BOTTLE WITH AN ANTIDRIP NECK

(76) Inventor: Nicolò Grillo, Località Lo Spicchio, 61-53017 Radda In Chianti (IT)

( * ) Notice: Subject to any disclaimer, the term of this patent is extended or adjusted under 35 U.S.C. 154(b) by 0 days.

(21) Appl. No.: 10/312,305

(22) PCT Filed: Jun. 15, 2001

(86) PCT No.: PCT/IT01/00317

§ 371 (c)(1),
(2), (4) Date: Dec. 20, 2002

(87) PCT Pub. No.: WO01/98156

PCT Pub. Date: Dec. 27, 2001

(65) Prior Publication Data

US 2003/0106873 A1 Jun. 12, 2003

(30) Foreign Application Priority Data

Jun. 22, 2000 (IT) ..... SI20000004 U

(51) Int. Cl.[7] ..... B65D 23/06; B65D 1/02
(52) U.S. Cl. ..... 215/41; 215/40; 215/392
(58) Field of Search ..... 215/40, 41, 42, 215/381, 382, 392, 900

(56) References Cited

U.S. PATENT DOCUMENTS 1,172,627 A * 2/1916 Nitardy et al. ..... 215/365
2,012,487 A * 8/1935 Swanson ..... 215/41
2,318,611 A * 5/1943 Jackson ..... 215/41
2,708,049 A * 5/1955 Sokolik ..... 215/41
2,788,161 A 4/1957 Kemper
4,009,794 A 3/1977 Zapp
4,493,427 A 1/1985 Wolkonsky

FOREIGN PATENT DOCUMENTS

DE 3123902 A1 * 6/1982 ..... B65D/1/02
WO WO 8907553 8/1989

* cited by examiner

*Primary Examiner*—Sue A. Weaver
(74) *Attorney, Agent, or Firm*—Steinberg & Raskin, P.C. Grant E. Pollack

(57) ABSTRACT

A bottle is disclosed which comprises a neck that forms an upwardly extending mouth from and through which a liquid flows, and a first potion for preventing liquid residue from dripping upon the outer surface of the neck. The first portion includes at least one annular groove formed integrally with the outer surface of the neck near the mouth. The groove is defined by a frustoconical portion of the surface, coaxial to a central axis of the neck and having a diameter that decreases in a generally downward direction. It is also defined by an annulus-shaped portion, lying on a plane substantially normal to the axis and relatively smoothly filleted with the frustonconical portion. The maximum diameter of the annulus-shaped portion is substantially equal to the maximum diameter of the frustoconical portion.

9 Claims, 2 Drawing Sheets

GLASS BOTTLE WITH AN ANTIDRIP NECK

FIELD OF THE INVENTION

The present invention relates generally to the field of containers for storing and dispensing liquids and, more particularly, to bottles for beverages such as wine or the like.

BACKGROUND OF THE INVENTION

A well known inconvenience of conventional beverage containers, e.g., wine bottles, is that each time wine is poured, liquid residue tends to form on the neck of the bottle, especially near its mouth. While this occurrence —generally speaking—takes place with any kind of liquid, it has been found particularly problematic and annoying in the case of wine. Since wine has a relatively low viscosity, such residues tend to flow down relatively quickly and easily along the body of the bottle, toward the supporting plane or surface upon which the bottle is standing. Upon reaching the surface, the residues often effect a considerable stain on both the surface and the tablecloth usually covering the same. Because wine stains are very difficult to remove, the surface and the tablecloth are typically indelibly stained with various blots. This is especially evident when the surface is made of marble or wood that has not been suitably pretreated. Furthermore, the body of the bottle remains soiled and slippery, making it inconvenient and troublesome to use.

In an attempt to overcome these disadvantages, a variety of solutions have been proposed. Typically with these solutions, the mouth of the bottle has a supplemental anti-dripping element, fixed or movable, consisting in a duct or sleeve engaged within the mouth. The element, due to its peculiar shape, or to characteristics of the material from which it is made, can prevent formation and/or dripping of the residues. Even without considering the efficiency of such systems, their success has been hindered considerably by their complicated construction, as well as the higher production costs often associated with the use of an additional component. Moreover, many of these solutions lessen considerably the aesthetic appeal of the bottle, a significant disadvantage in the industry.

Other arrangements have an outer surface of the bottle neck, near the mouth, that is modified to make the liquid dripping stop/stagnate thereon. However, one or more additional members are similarly added to the traditional glass structure of the bottle, with the same drawbacks as the previously mentioned solutions. Still further attempts include an integral stop on the bottle neck, formed during the molding step of the glass material. Such attempts have also been unsuccessful, because they could not suitably combine the ability to prevent formation anchor dripping of residue with satisfactory esthetics and reduced production costs.

OBJECTS AND SUMMARY OF THE INVENTION

According, a solution is desired that, when applied to a glass bottle, in particular but not exclusively a wine bottle of the so-called "without capsule" type, effectively prevents formation and/or dripping of liquid residues, has extraordinarily appealing aesthetics, and has production costs substantially equivalent to those of a conventional bottles.

According to one aspect of the present invention, a bottle, e.g. constructed of glass, is provided comprising a neck that forms an upwardly extending mouth from and through which a liquid flows, and a first portion in proximity to the mouth for preventing liquid residue from dripping upon an outer surface of the neck, the first portion comprising at least one annular groove formed integrally with the outer surface of the neck and defined by a frustoconical portion of the surface, coaxial to a central axis of the neck and having a diameter that decreases in a generally downward direction, and by an annulus-shaped portion, lying on a plane substantially normal to the axis and relatively smoothly filleted with the frustonconical portion, the maximum diameter of the annulus-shaped portion being substantially equal to the maximum diameter of the frustoconical portion.

The at least one groove, shaped as set forth above, adequately stops liquid residues generated after the liquid has been poured from the bottle. The residues flow downward along the frustoconical portion and spread over the annulus-shaped portion, reaching a point where adhesion to the surface of the glass tends to overcome the force of gravity. Such groove(s) can also be obtained readily, and directly during the glass molding step, using a die that requires minimally modification as compared to a traditional one. In addition, the linearity and sobriety of the groove's shape do not impair the aesthetics of the bottle.

Preferably, at least two grooves are provided, even more preferably three or four, arranged in series so that the annulus-shaped portion of a groove is radiused with the frustoconical portion of the adjacently lower groove, the radius being much sharper than the fillet at the bottom of the groove. In this way, even relatively abundant liquid residues, which may overflow a first groove, can be stopped by the next ones.

In an embodiment considered most advantageous, the taper of the frustoconical portion between about 22° and about 24° and the width of the groove, measured axially between the relevant annulus-shaped portion and the one of the adjacently higher grooves, is about 6 mm. This implies a groove depth, measured radially, equal to about 4 mm. A superior result, in terms of residue stoppage, is thus obtained, without excessive reduction in glass thickness relative to the neck. This, in turn, avoids structural weakening of the bottle, as well as development of inward ribs which are often an obstacle when inserting removing the cork plug.

BRIEF DESCRIPTION OF THE DRAWINGS

These and other objects and advantages of the bottle with anti-drip neck, according to the present invention, will become apparent from the description of specific, illustrative embodiments thereof set forth below with reference to the following drawings in which.

The same numerals are used throughout the drawing figures to designate similar elements. Still other objects and advantages of the present invention will become apparent from the following description of the preferred embodiments.

DESCRIPTION OF THE PREFERRED EMBODIMENT

Figure 1:
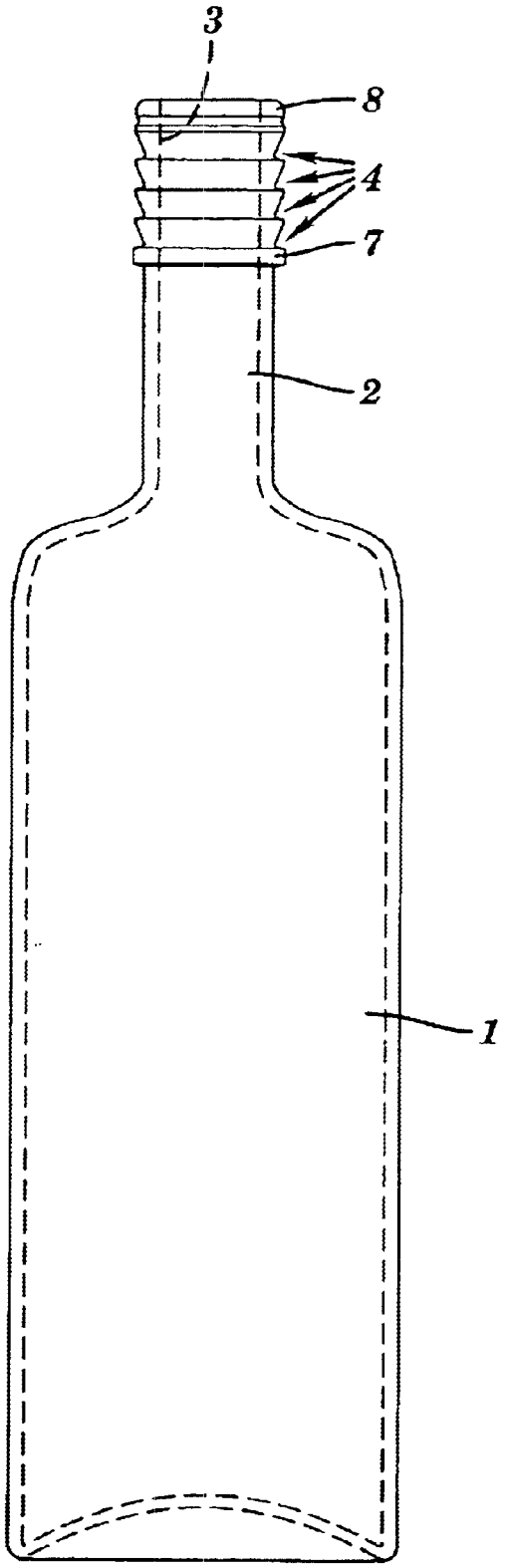
FIG. 1 is a schematic side view of a bottles according to one embodiment of the present invention.
Figure 2:
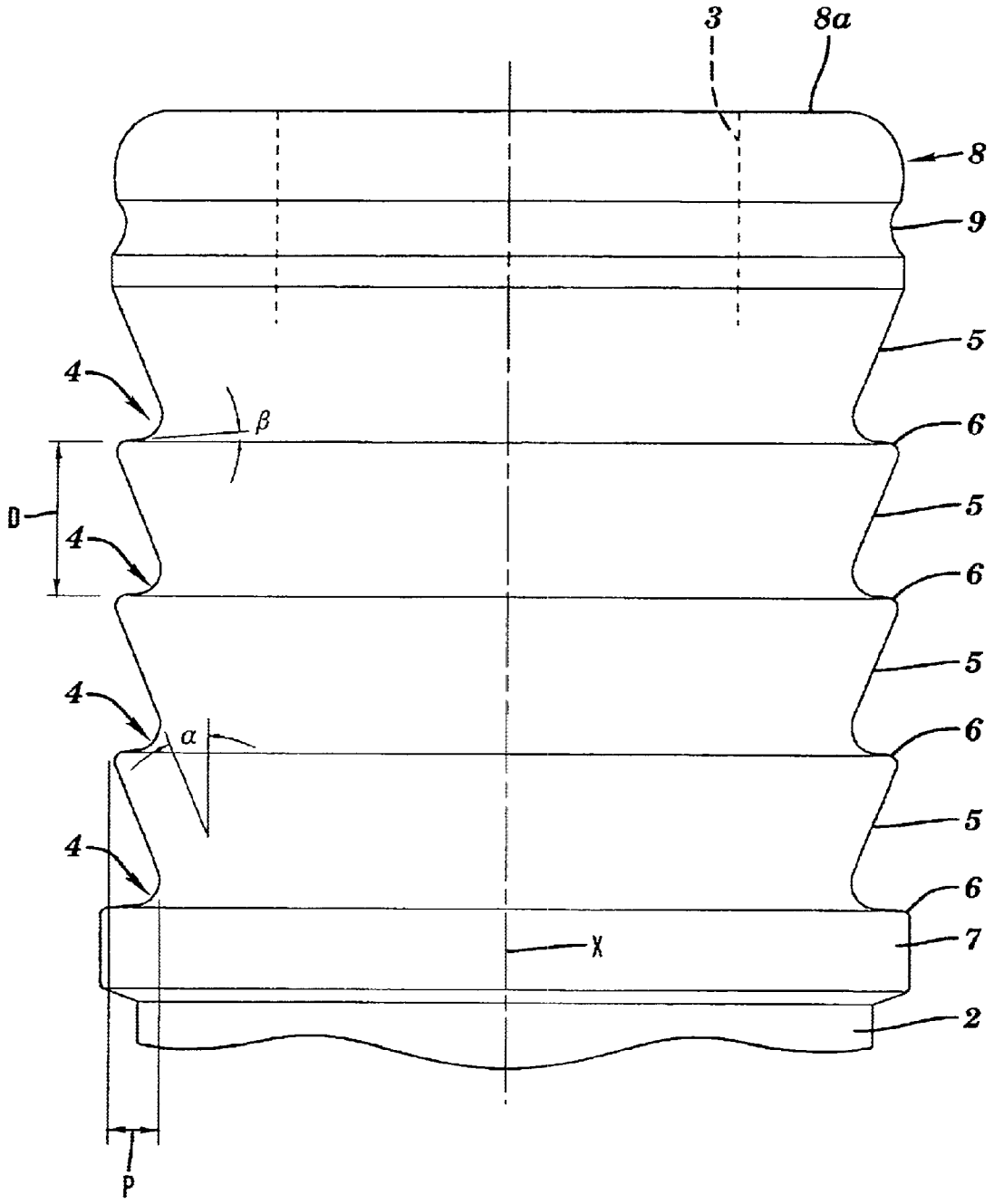
FIG. 2 is an enlarged side view of the top end of the neck of the bottle shown in FIG. 1.

Referring now to the drawings and, more particularly, to FIGS. 1 and 2, there is shown generally a specific, illustrative bottle, e.g., a wine bottle, having an anti-drip neck, according to various aspects of the present invention.

According to one embodiment, the bottle is made of glass, conventionally comprising a cylindrical body 1, from the upper part of which a neck 2 coaxially extends. The neck is, for example and typically, cylindrical as well, but has a considerably smaller diameter. At the top end, neck 2 has a mouth 3, from and through which liquid contained in the bottle flows. According to one aspect of the present invention, on the outer surface of the neck, near mouth 3, at least one annular groove 4 is formed, the function of which is to prevent liquid residues from dripping after liquid has been poured from the mouth.

More precisely, referring in particular to FIG. 2, a groove 4 is defined by a frustoconical portion 5 of said outer surface, coaxial to the central axis of the neck—indicated at X—and having a diameter which decreases downwards, and by an annulus-shaped portion 6, laying on a plane which is substantially (but preferably not exactly, as explained hereinafter) normal to axis X. The frustoconical and annulus-shaped portions 5 and 6, the respective maximum diameters of which are substantially equal, are smoothly filleted with each other. Considering as a basis the bottle typical size characteristics which will be referred to hereinafter, said smoothness effect will be obtained with a filleting radius of about 1 mm (or even with a slightly smaller one).

In the depicted example, four grooves 4 arranged in series are provided, each annulus-shaped portion 6 being radiused with the adjacently lower frustoconical portion 5, the radius being much sharper than the fillet at the bottom of the groove. The first groove 5 (that is, the highest one) and the last one (the lowest one) are respectively adjacent to a top end enlargement 8, defining an upwards face 8*a* on which mouth 3 opens, and to a lower ring 7 under which the remaining part of neck 2 extends. A further annular gutter-like groove 9 may be formed in enlargement 8.

In the embodiment shown, the taper of each frustoconical portion 5, indicated at $\alpha$, is about 22–24°, and the width of each groove 4—intended as the axially measured distance D between two consecutive annulus-shaped portions 6—is about 6 mm. From this follows that the groove has a depth P, measured radially, of about 4 mm. In this respect, it has to be considered that the general size (outer and inner diameter) of the bottle neck is a result of substantially standardized design parameters, to which it is therefore necessary to keep to.

Considering such limitation, the above mentioned optimum values make it possible to maximize the increase, with respect to the traditional cylindrical conformation, of the useful surface for decelerating the residues, at the same time affecting a reduced axial segment of neck 2 and most of all avoiding an excessive decrease of the glass thickness. This last aspect is very important because if the thickness descends below a certain value, the structure becomes weaker and the inner surface of the neck 2, in correspondence to the bottom of grooves 4, forms ribs which turn out to be an obstacle when placing and removing the cork plug.

As mentioned above, the annulus-shaped portion 6 preferably does not lie on the plane which is normal to axis X of neck 2, but is inclined with respect to said plane by a draft angle $\beta$ of about 4°, thanks to which the formation of superficial defects is avoided.

It will be apparent that the bottle according to the invention, due to its simple axially symmetrical structure, can be produced with the same technique of traditional bottles, simply using a properly modified die. The bottle will be particularly suitable for adopting the closing system without a protective capsule, i.e. that system in which a guarantee seal affects only the upwards side 8*a* in which mouth 3 opens. In fact, if a capsule does not coat the side surface of neck 2, the grooves 4 can carry out their antidrip function immediately and directly. If, on the contrary, the traditional capsule is present, it will have to be completely removed when the bottle is opened.

Even if in the description and in the drawings a bottle of the so-called "bordolese" type has always been referred to, of course the proposed solution can be suitable, with minor changes, for other kinds of wine bottles, for example the "borgognotta" and "alsaziana", and also for other liquids for which analogous antidrip needs arise, in particular oil. As mentioned, the arrangement of four grooves 4 in a series is enough to stop the dripping of even relatively abundant liquid residuals. On the other hand, when suitable according to the specific circumstances, a different number of grooves may be adopted.

Various modifications and alterations to the present invention may be appreciated based on a review of this disclosure. These changes and additions are intended to be within the scope and spirit of the invention as defined by the following claims.

What is claimed is:

1. A bottle comprising a neck that forms an upwardly extending mouth from and through which a liquid flows, and a first portion in proximity to the mouth for preventing liquid residue from dripping upon an outer surface of the neck, the first portion comprising at least one annular groove formed integrally with the outer surface of the neck, the groove being defined by a frustoconical portion of the surface, coaxial to a central axis of the neck and having a diameter that decreases in a generally downward direction, and by an annulus-shaped portion, lying on a plane substantially normal to the axis and relatively smoothly filleted with the frustoconical portion, the maximum diameter of the annulus-shaped portion being substantially equal to the maximum diameter of the frustoconical portion, wherein the taper of the frustoconical portion is generally within a range of 22° and 24°, the width of the at least one groove, measured axially, is about 6 mm, and the depth of the groove, measured radially, is equal to about 4 mm.

2. The bottle set forth in claim 1, wherein at least two grooves are provided, in series, so that the annulus-shaped portion of a first of the grooves is radiused with the frustoconical portion of a second, adjacent and lower of the grooves, the radius being much sharper than the fillet at the bottom of the groove.

3. The bottle set forth in claim 2, comprising three or more grooves arranged in series.

4. A bottle comprising a neck that forms an upwardly extending mouth from and through which a liquid flows, and a first portion in proximity to the mouth for preventing liquid residue from dripping upon an outer surface of the neck, the first portion comprising at least one annular groove formed integrally with the outer surface of the neck, the groove being defined by a frustoconical portion of the surface, coaxial to a central axis of the neck and having a diameter that decreases in a generally downward direction, and by an annulus-shaped portion, lying on a plane substantially normal to the axis and relatively smoothly filleted with the frustoconical portion, the maximum diameter of the annulus-shaped portion being substantially equal to the maximum diameter of the frustoconical portion, wherein between the at least one groove and mouth, the neck integrally provides a radial enlargement in which a supplementary gutter-like annular groove is formed.

5. The bottle set forth in claim 4, wherein at least two grooves are provided, in series, so that the annulus-shaped portion of a first of the grooves is radiused with the frustoconical portion of a second, adjacent and lower of the grooves, the radius being much sharper than the fillet at the bottom of the groove.

6. The bottle set forth in claim 4, comprising three or more grooves arranged in series.

7. A bottle comprising a neck that forms an upwardly extending mouth from and through which a liquid flows, and a first portion in proximity to the mouth for preventing liquid residue from dripping upon an outer surface of the neck, the first portion comprising at least one annular groove formed integrally with the outer surface of the neck, the groove being defined by a frustoconical portion of the surface, coaxial to a central axis of the neck and having a diameter that decreases in a generally downward direction, and by an annulus-shaped portion, lying on a plane substantially normal to the axis and relatively smoothly filleted with the frustoconical portion, the maximum diameter of the annulus-shaped portion being substantially equal to the maximum diameter of the frustoconical portion, wherein the annulus-shaped portion is inclined at an angle of about 4°, with respect to the plane normal to the central axis of the neck.

8. The bottle set forth in claim 7, wherein at least two grooves are provided, in series, so that the annulus-shaped portion of a first of the grooves is radiused with the frustoconical portion of a second, adjacent and lower of the grooves, the radius being much sharper than the fillet at the bottom of the groove.

9. The bottle set forth in claim 8, comprising three or more grooves arranged in series.

* * * * *